United States Patent [19]

Bisagno et al.

[11] Patent Number: 4,771,478

[45] Date of Patent: Sep. 20, 1988

[54] TOWEL AND GARMENT MEANS

[76] Inventors: David A. Bisagno, Box 608, Augusta, Kans. 67010; Roger R. Stuber, 101 Westview, Wichita, Kans. 67230; Joseph C. Eash, 351 Grand Ave., Augusta, Kans. 67010

[21] Appl. No.: 33,838

[22] Filed: Apr. 3, 1987

[51] Int. Cl.[4] ..... A41D 1/00

[52] U.S. Cl. ..... 2/69; 2/DIG. 6; 2/227; 2/211; 2/238; 2/300

[58] Field of Search ..... 2/DIG. 6, 69, 227, 211, 2/238, 244, 300; 206/205

[56] References Cited

U.S. PATENT DOCUMENTS 3,063,749 11/1962 Struble et al. ..... 2/DIG. 6

3,760,461 9/1973 Wright ..... 2/DIG. 6

4,564,975 1/1986 Scharf ..... 2/DIG. 6

4,633,527 1/1987 Ehring ..... 2/227

*Primary Examiner*—Henry S. Jaudon

*Attorney, Agent, or Firm*—John Wade Carpenter

[57] ABSTRACT

A combination of a removable towel and shorts that comprises a plurality of loops secured to the waistband of the shorts. A flap is pivotally mounted to the waistband and has a plurality of hooking elements on its bottom side. A pair of flaps. A toweling is provided. The toweling has a plurality of hooking elements. Each flap of the pair of flaps has a button slot wherethrough a pair of buttons secured to the singular flap passes for affixing the pair of flaps to the singular flaps.

14 Claims, 2 Drawing Sheets

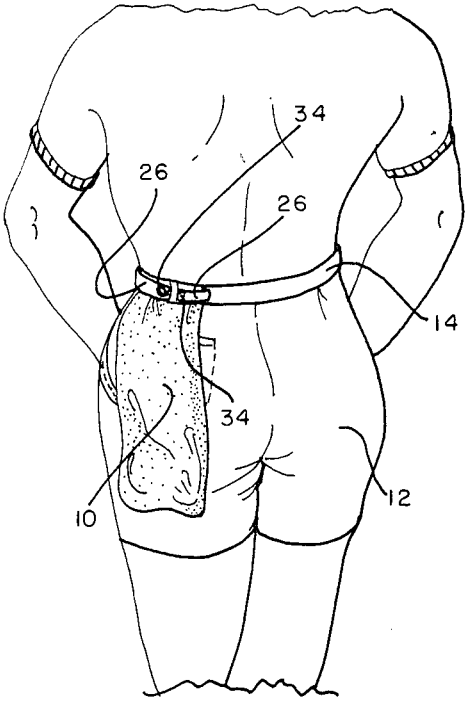
FIG. 1
FIG. 2
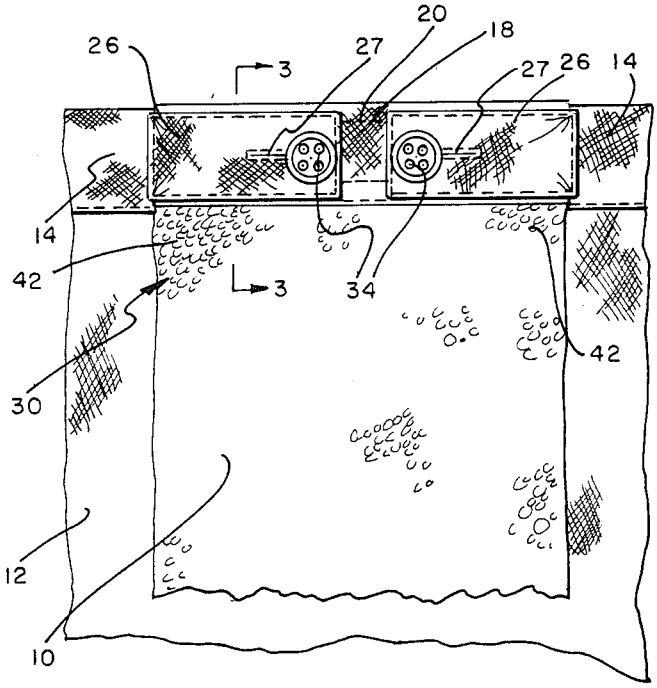
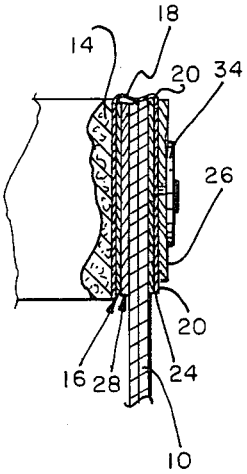
FIG. 3
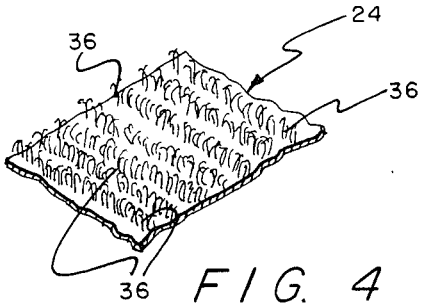
FIG. 4
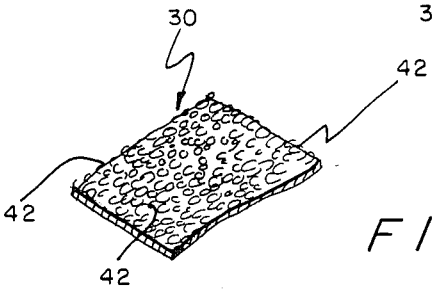
FIG. 5

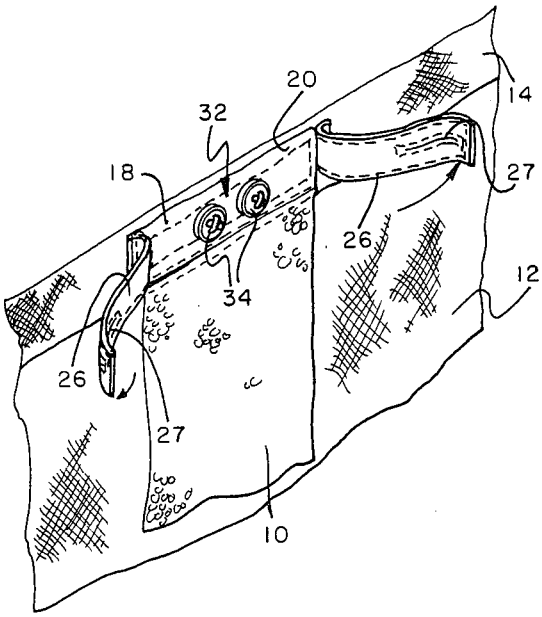
FIG. 6
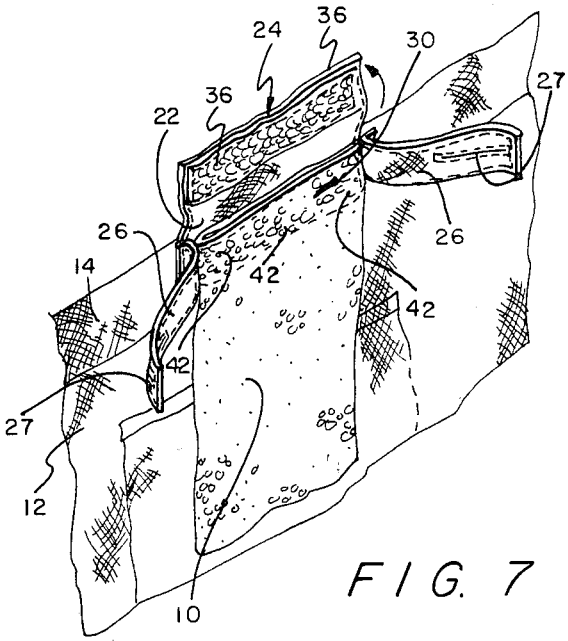
FIG. 7
FIG. 8
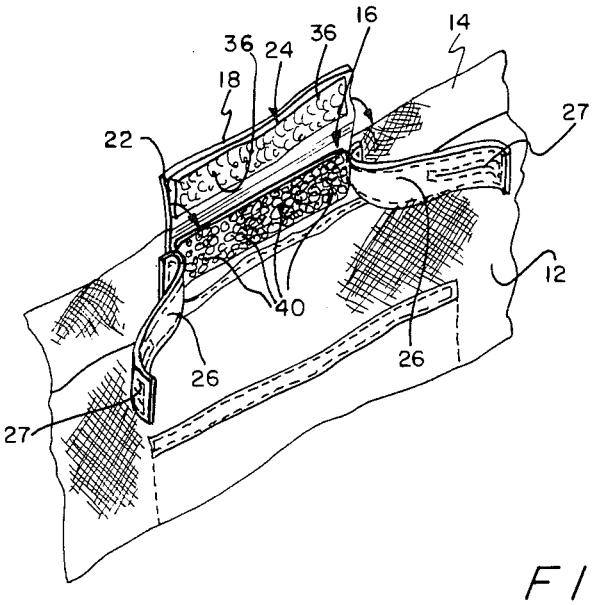
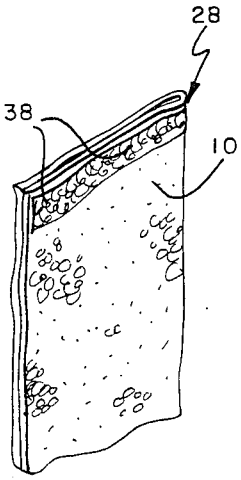
FIG. 9

TOWEL AND GARMENT MEANS

BACKGROUND OF THE INVENTION

1. Field of the Invention

This invention provides a towel and garment means. More particularly, this invention provides a combination of a towel and shorts, and an article-holding system.

2. Description of the Prior Art

U.S. Pat. No. 4,403,366 by Lucke teaches a towel and mounting method and means. U.S. Pat. No. 4,448,560 to Monoco discloses a rosin bag and towel attached together. U.S. Pat. No. 4,168,544 by Kallman depicts an article-holding system having a flap with VELCRO® on opposed sides. None of the foregoing prior art teach or suggest the particular towel and shorts combination of this invention.

SUMMARY OF THE INVENTION

This invention accomplishes its desired objects by broadly providing an article-holding system comprising a first receiver means secured to an article of clothing of a user; and a first flap means pivotally bound to the article of clothing and adapted for pivoting over the first receiver means for retaining an article between the first receiver means and the first flap means. A pair of second flap means is pivotally secured to the article of clothing such that the first receiver means is between the pair of second flap means in close proximity to the points of pivotation of the pair of second flap means to the article of clothing. Attached to the first flap means is a means for fastening the pair of second flap means to the first flap means. The first flap means comprises a top side and a bottom side, and the means for fastening the pair to the first flap means is secured to the top side. A first gripping means is secured to the bottom side of the first flap means. Each of the second flap means comprises a structure defining a button slot for removably receiving a button. The means for fastening preferably comprises a pair of buttons attached to the top side of the first flap means which slidably pass through the button slots for retaining the pair of second flap means against the first flap means. The first receiver means comprises a plurality of flexible loop elements, and the first gripping means comprises a plurality of exposed flexible first hooking elements projecting from the bottom side of the first flap means. The article-holding system additionally broadly comprises a second gripping means secured to the article being held between the first flap means and the first receiver means. The second gripping means comprises a plurality of exposed flexible hooking elements projecting from the article.

This invention further accomplishes its desired objects by more particularly providing a combination of removable towel means-clothing comprising a removable towel means for mounting on clothing of a user. The removable towel means and clothing is a combination which preferably comprises a first receiving means secured to the clothing; a first flap means having a top side and a bottom side and pivotally bound to the clothing and adapted for pivoting over the first receiver means; and a first gripping means secured to the bottom side of the first flap means. The removable towel means-clothing combination additionally comprises a pair of second flap means pivotally secured to the clothing such that the first receiver means is between the pair of second flap means in close proximity to the points of pivotation to the pair of second flap means to the clothing in order that the pair of second flap means can be superimposed on the top side of the first flap means when the first flap means is folded over the first receiver means. A toweling is provided, and a second gripping means is secured to the toweling for complementarily securing the toweling to the first receiver means. Secured to the top side of the first flap means is a means for fastening the pair of second flap means to the first flap means. In a more preferred embodiment of the invention, the toweling is a structure defining a second receiver means for complementarily securing the first gripping means to the toweling.

It is an object of this invention to provide an article-holding system.

It is another object of this invention to provide in combination a removable towel means for mounting on clothing of a user.

These, together with the various ancillary objects and features which will become apparent as the following description procedes, are attained by this invention, preferred embodiments being shown in the accompanying drawings, by way of example only, wherein:

BRIEF DESCRIPTION OF THE DRAWINGS

FIG. 1 is a perspective view of the combination of the removable towel being secured to the waist band of shorts;

FIG. 2 is a partial vertical view of the towel being secured to the waist band of the shorts;

FIG. 3 is a vertical sectional view taken in direction of the arrows and along the plane of line 3—3 in FIG. 2;

FIG. 4 is a partial perspective view of the resilient hooking elements that define the first gripping means positioned underneath the flap and the second gripping means positioned on an end of the towel;

FIG. 5 is a partial perspective view of the looping elements of this invention that define the first receiver means secured to the waistband of the shorts and further define part of the structure of the towel;

FIG. 6 is a partial perspective view of the top end of the towel having been sandwiched by the flap for retention of the towel to the waistband of the shorts;

FIG. 7 is a partial perspective view of the gripping means of the towel engaged and held thereagainst to the receiver means on the waistband of the shorts;

FIG. 8 is a partial perspective view disclosing the flap with its underneath side having hooking elements, and the waistband of the shorts which includes the looping elements along with a pair of flaps that are separated by the looping elements; and FIG. 9 is a partial perspective view of the folded towel with one of its ends having thereon hooking elements.

DETAILED DESCRIPTION OF THE INVENTION

Referring in detail now to the drawings for the more preferred embodiment of the invention and wherein similar parts of the invention are identified by like reference numerals, there is seen the inventive combination of a removable towel 10 mounted on shorts 12 having a waistband 14. A first receiver means (see FIG. 8), generally illustrated as 16, is secured to the waistband 14 of the shorts 12. A flap 18 having a top side 20 and a bottom side 22 is pivotally bound to the waistband 14. Alternatively, the flap 18 is integrally, pivotally bound to any base (as described below in greater detail) of the first receiver means 16. In either case, the flap 18 is adapted for pivoting in direction of the arrows in FIG. 8 over and/or towards the first receiver means 16.

A first gripping means, generally illustrated as 24, is secured to bottom side 22 of the flap 18 as illustrated in FIGS. 7 and 8. A pair of flaps 26—26 is pivotally secured to the waistband 14 such that the first receiver means 16 separates the pair of flaps 26—26. More particularly, the first receiver means 16 is secured to the waistband 14 between the points of pivotation of the pair of flaps 26—26 to the waistband 14 such that the pair of flaps 26—26 can be folded over the top side 20 of the flap 18 to be superimposed thereon, as illustrated in FIGS. 2 and 3. Each of the pair of flaps 26—26 preferably contains a slot 27.

The towel 10 (see FIG. 9) has a second gripping means, generally illustrated as 28. Second gripping means 28 complements the first receiver means 16 such that the towel 10 may be complementarily secured to the flap 18. The towel 10 also has a structure defining a second receiver means, generally illustrated as 30, which complements the first gripping means 24 for securing complementarily the first gripping means 24 to the towel 10.

Secured to the top side 20 of the flap 18 is a means, generally illustrated as 32, for fastening the pair of flaps 26—26 to the flap 18, more particularly to the top side 20 of the flap 18. Preferably, the means for fastening 32 comprises a pair of buttons 34—34 (see FIG. 6) which slidably pass through the slots 27—27 for retaining the pair of flaps 26—26 against the top side 20 of the flap 18.

In a preferred embodiment of the invention, the first and second gripping means 24 and 28 and the first and second receiver means 16 and 30 is of the type marketed under the registered trademark VELCRO® brand hook and loop fasteners by Velcro Corporation. In VELCRO® brand hook and loop fasteners, a surface defined by the hooks is merely placed into face-to-face relationship with a surface defined by the loops so that a large number of hooks engage a large number of loops and therefore are able to resist separation by forces parallel to the interfacial plane of engagement but are readily separable by peeling forces applied substantially normal to this interfacial plane. Therefore, the first and second gripping means 24 and 28 comprise a plurality of mating hook-type hooking elements 36 and 38 upstanding from a surface thereof, respectively. Similarly, the first and second receiver means 16 and 30 comprise a plurality of resilient loop-type elements 40 and 42 respectively. When the plurality of mating hook-type hooking elements 20 on the end of towel 10 (see FIG. 9) is compressed under normal pressure against the plurality of relilient loop-type hooking elements 40 on the waistband 14, the towel 10 is attached to the shorts 12 at the waistband 14. Likewise, when the plurality of mating hook-type hooking elements 36 on the bottom side 22 of the flap 18 is compressed under manual pressure against the plurality of resilient loop-type hooking elements 42 on the structure of the towel 10 in order to secure the bottom side 22 of the flap 18 and sandwich the towel 10 between the folded flap 18, as illustrated in FIG. 6. This further secures the towel 10 to the shorts 12. In order to still yet further secure the towel 10 to the shorts and prevent the bottom side 22 of the flap 18 from lifting off surface of the towel 10, flaps 26—26 are folded over and superimposed on the top side 20 of the flap 18, and buttons 34—34 respectively slidably pass through the slots 27—27.

To remove the towel 10 from the shorts 12, simply disengage the buttons 34—34 from within the slots 27—27; pull flap 18 upward and/or outward, and generally normal with respect to the upstanding hooking elements 38, until the flap 18 (more particularly the bottom side 22) is disengaged off the towel 10; and subsequently pull towel 10 upward and/or outward and generally normal with respect to the resilient loop-type hooking elements 40 on the waistband 14 until towel 10 comes free.

While the VELCRO® receiving and gripping means is the preferred receiver means 16 and 30 and the preferred gripping means 24 and 28, it should be understood that any type of receiver, gripping or fastener means is contemplated within the spirit and scope of this invention. For example, any flexible engaging elements, including mushroom-like elements, resilient projections, etc., which are readily securable in face-to-face relation, and which particularly resist forces parallel to the interfacial plane of engagement, are contemplated within the spirit and scope of the present invention. Such mushroom configured hooking elements as the type disclosed in U.S. Pat. Nos. 3,138,841 and 3,320,649 both to Naimer, and U.S. Pat. Nos. 3,718,725 and 3,770,359 both to Hamano are contemplated. Further examples of knitted form fastener members contemplated within the scope of the present invention are disclosed in U.S. Pat. Nos. 3,530,687 and 3,539,436 both to Hamano.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. An article-holding system comprising a first receiver means secured to an article of clothing of a user;

a first flap means pivotally bound to said article of clothing and adapted for pivoting over said first receiver means for retaining an article between said first receiver means and said first flap means;

a pair of second flap means pivotally secured to said article of clothing such that said first receiver means is between said pair of second flap means in close proximity to the points of pivotation of the pair of second flap means to the article of clothing; and means secured to said first flap means for fastening said pair of second flap means to said first flap means.

2. The article-holding system of claim 1 wherein said first flap means comprises a top side and a bottom side, said means for fastening said pair of second flap means to said first flap means is secured to said top side, and a first gripping means secured to the bottom side.

3. The article-holding system of claim 2 wherein each of said second flap means comprises a structure defining a button slot for removably receiving a button attached to said top side of said first flap means which slidably pass through the button slots for retaining said pair of second flap means against said first flap means.

4. The article-holding system of claim 3 wherein said first receiver means comprises a plurality of flexible loop elements, and said first gripping means comprises a plurality of exposed flexible first hooking elements projecting from the bottom side of said first flap means.

5. The article-holding system of claim 4 additionally comprising a second gripping means secured to said article being held between said first flap means and said first receiver means.

6. The article-holding system of claim 5 wherein said second gripping means comprises a plurality of exposed flexible second holding elements projecting from said article.

7. In combination a removable towel means for mounting on clothing of a user comprising in combination:

(a) a first receiver means secured to said clothing;

(b) a first flap means having a top side and a bottom side and pivotally bound to said clothing and adapted for pivoting over said first receiver means;

(c) a first gripping means secured to the bottom side of said first flap means;

(d) a pair of second flap means pivotally secured to the clothing such that said first receiver means is between said pair of second flap means in close proximity to the points of pivotation of the pair of second flap means to the clothing in order that the pair of second flap means can be superimposed on the top side of said first flap means when the first flap means is folded over the first receiver means;

(e) a toweling;

(f) a second gripping means secured to said toweling for complementarily securing said toweling to said first receiver means; and (g) a means secured to the top side of said first flap means fastening said pair of second flap means to said first flap means.

8. The removable towel means and clothing combination of claim 7 wherein said toweling has a structure defining a second receiver means for complementarily securing said gripping means to said toweling.

9. The removable towel means and clothing combination of claim 8 wherein each of said second flap means comprises a structure defining a button slot for removably receiving a button in each button slot, and said means for fastening comprises a pair of buttons attached to said top side of said first flap means which slidably pass through the button slots for retaining said pair of second flap means against said first flap means.

10. The removable towel means and clothing combination of claim 9 wherein said first receiver means comprises a plurality of first flexible loop elements, and said first gripping means comprises a plurality of exposed flexible first hooking elements projecting from the bottom side of said first flap means.

11. The removable towel means and clothing combination of claim 10 wherein said second gripping means comprises a pluralilty of exposed flexible second hooking elements projecting from said toweling, said plurality of first flexible loop elements are adapted to receive and hold said plurality of second hooking elements when applied thereto under manual pressure and to be disengaged from said plurality of second hooking elements when pulling outward and generally normal with respect thereto.

12. The removable towel means and clothing combination of claim 11 wherein said second receiver means comprises a plurality of second flexible loop elements which are adapted to receive and hold said first hooking elements projecting from said bottom side of said first flap means when applied thereto under manual pressure and to be disengaged from said plurality of first hooking elements when pulling outward and generally normal with respect thereto.

13. The removable towel means and clothing combination of claim 12 wherein said clothing is shorts.

14. The removable towel means and clothing combination of claim 13 wherein said shorts comprises a waistband, and said first receiver means is secured to said waistband.

* * * * *